US006958450B2

(12) United States Patent
Keser et al.

(10) Patent No.: US 6,958,450 B2
(45) Date of Patent: Oct. 25, 2005

(54) CONNECTION APPARATUS, SYSTEMS, AND METHODS

(75) Inventors: Milan Keser, Chandler, AZ (US); Kevin M. Lenio, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 195 days.

(21) Appl. No.: 10/405,098

(22) Filed: Mar. 31, 2003

(65) Prior Publication Data

US 2004/0190278 A1 Sep. 30, 2004

(51) Int. Cl.[7] ..... H01B 7/08
(52) U.S. Cl. ..... 174/117 F
(58) Field of Search ..... 174/117 F, 117 FF, 174/71 R, 72 A; 361/826

(56) References Cited

U.S. PATENT DOCUMENTS 6,344,616 B1 * 2/2002 Yokokawa ..... 174/117 F

FOREIGN PATENT DOCUMENTS

EP GB 2 275 373 * 8/1994

* cited by examiner

*Primary Examiner*—Chau N. Nguyen
(74) *Attorney, Agent, or Firm*—Schwegman, Lundberg, Woessner & Kluth P.A.

(57) ABSTRACT

Apparatus and systems, as well as fabrication methods therefor, may include a component having a plurality of contacts substantially equally spaced apart from each other by a first distance along a first line coupled to an angled parallel conductor group having a plurality of conductors substantially equally spaced apart from each other by a second distance less than the first distance along a second line.

29 Claims, 5 Drawing Sheets

CONNECTION APPARATUS, SYSTEMS, AND METHODS

TECHNICAL FIELD

The subject matter relates generally to apparatus, systems, and methods used to conduct energy, such as electrical energy, to various components, including circuit components.

BACKGROUND INFORMATION

Conductors may be used to transfer energy and/or information among various components. At times, multiple conductors may be arranged in parallel, such that each conductor in a sub-group is substantially parallel to the others, and spaced apart from its neighbors in a substantially flat, periodic, and linear fashion. Such conductor arrangements, including one or more sub-groups, will be referred to collectively hereinafter as "parallel conductors". Thus, a parallel conductor may include one or more sub-groups of conductors, wherein the conductors in one sub-group may not be spaced apart from each other by the same distance as conductors included in another sub-group. Examples include, but are not limited to, any type of linearly grouped conductors, whether of substantially the same type, such as "FLEX-LITE™ cable" having fiber optic conductors (e.g., W.L. Gore and Associates #FOA 8100/1/10/2), "ribbon cable" having electrical conductors (e.g., 3M Company #3302/10), and "flex-tape" having conductors which may be attached to a flexible substrate (e.g., Elmec Manufacturing #R24-1.5-.100-16-.187T), or of different types (e.g., a group having sub-groups of both fiber optic and radio frequency conductors).

When parallel conductors are used with components that have ports or contacts spaced to match the linear spacing of the individual conductors (e.g., a connector designed to be crimped onto a particular type of ribbon cable), the conductor end-points line up directly with the ports/contacts, and the desired series of connections can easily be made. However, if the contact/port spacing does not match the spacing of conductors in a parallel conductor, a problem arises. For example, when the contact spacing on a die is greater than the trace conductor spacing of available flex-tape, then the tape is typically "fanned-out" to match the die contact spacing, significantly increasing the cost of the tape. Thus, there is a need for apparatus, systems, and methods that can be used to match parallel conductor spacing to various components that have non-matching port/contact spacing.

DETAILED DESCRIPTION

Figure 1:
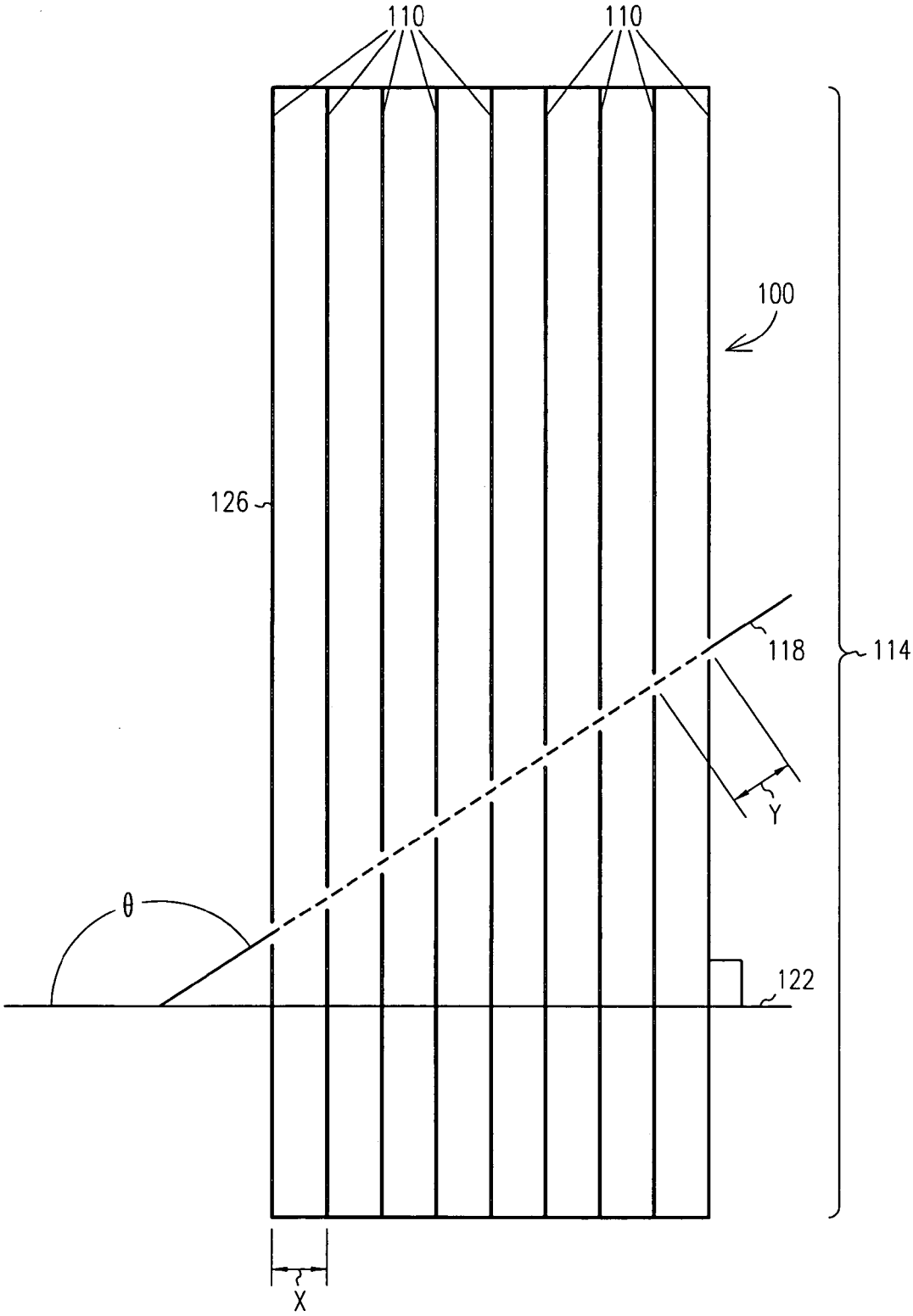
FIG. 1 is a top view of an angled parallel conductor group formed according to various embodiments of the invention.

In the following detailed description of various embodiments of the invention, reference is made to the accompanying drawings that form a part hereof, and in which are shown by way of illustration, and not of limitation, specific embodiments in which the subject matter may be practiced. In the drawings, like numerals describe substantially similar components throughout the several views. The embodiments illustrated are described in sufficient detail to enable those skilled in the art to practice the teachings disclosed herein. Other embodiments may be utilized and derived therefrom, such that structural, compositional, and logical substitutions and changes may be made without departing from the scope of this disclosure. The following detailed description, therefore, is not to be taken in a limiting sense, and the scope of various embodiments of the invention is defined only by the appended claims, along with the full range of equivalents to which such claims are entitled.

FIG. 1 is a top view of an angled parallel conductor group 100 formed according to various embodiments of the invention. In this case, the angled parallel conductor group 100 may be formed from a plurality of conductors 110 included in a parallel conductor 114. Conductors 110 in a sub-group may be substantially parallel to each other as well as substantially equally spaced apart from each other by a pitch distance X. If the plurality of conductors 110 is cut along a line 118 at an angle θ, the natural pitch distance X between the plurality of conductors 110 will be increased to a new pitch Y along the line 118. The angle θ may be greater than 90 degrees and less than 180 degrees, as measured from a line 122 that is located perpendicular to an axis 126 parallel to each one of the plurality of conductors 110 included in the angled parallel conductor group 100. Thus, for example, if a parallel conductor 114 includes a plurality of conductors 110 spaced apart by a pitch X, a square cut across the plurality of conductors 110 along the line 122 will have the endpoints of the plurality of conductors 110 located at a pitch distance X. However, if the cut is made along a line 118, at an angle θ, the trace pitch of the conductor end points will change to Y, where $Y=X/\cos(180-\theta)$. Therefore, many different pitch distances Y can be achieved along the line 118 using a plurality of conductors 110 spaced apart from each other in a substantially parallel manner by a pitch X by choosing a cut angle θ, such that $\theta=180-\cos^{-1}(X/Y)$.

Figure 2:
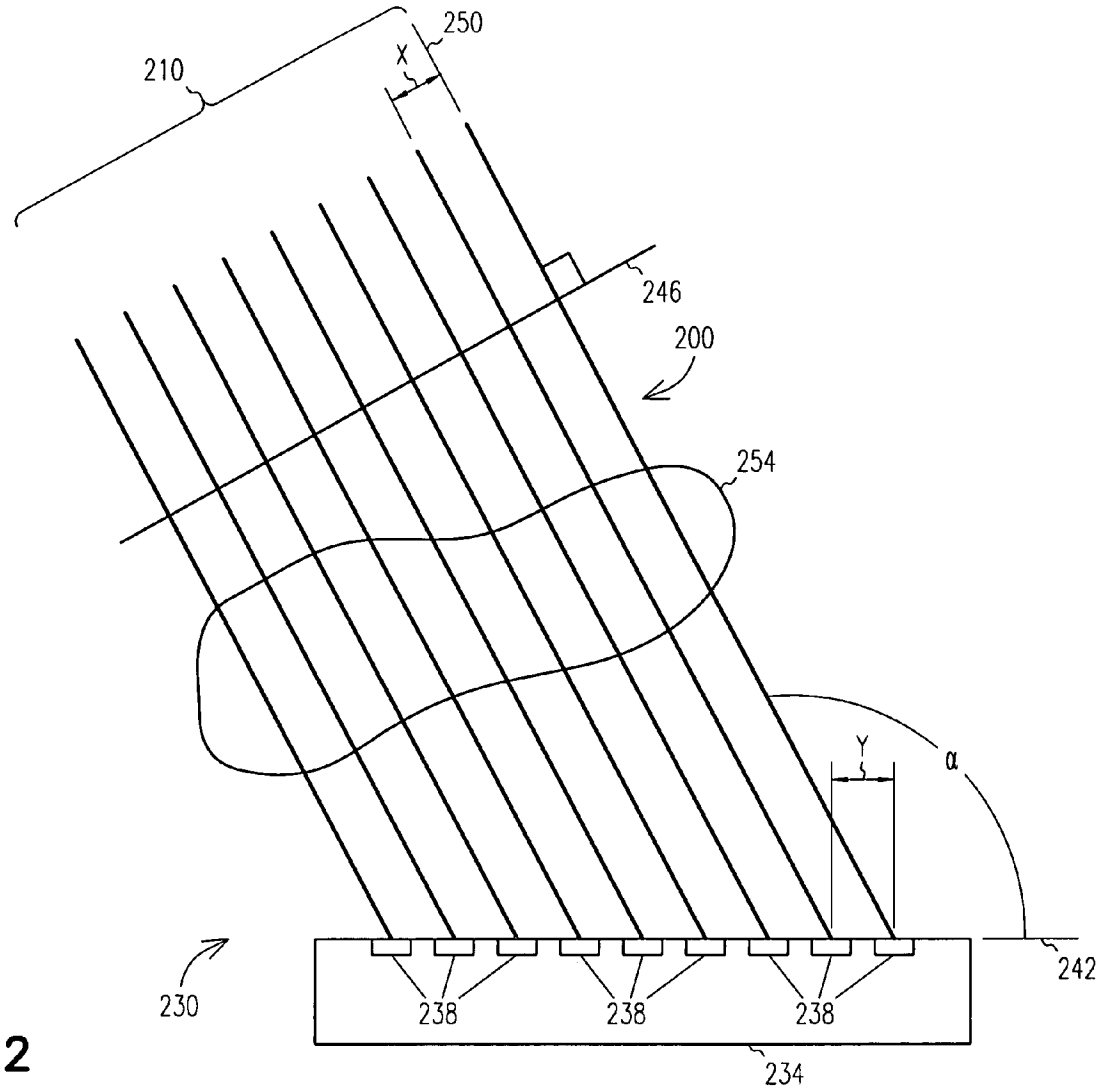
FIG. 2 is a top view of an apparatus according to various embodiments of the invention.

FIG. 2 is a top view of an apparatus 230 according to various embodiments of the invention. The apparatus 230 may comprise a component 234 having a plurality of contacts 238 substantially equally spaced apart from each other by a distance Y along a line 242. The apparatus 230 may also comprise an angled parallel conductor group 200 having a plurality of conductors 210 in a sub-group substantially equally spaced apart from each other by a distance X, which may be less than the distance Y. The distance X may be measured along the line 246, which may be perpendicular to an axis 250 parallel to each one of the plurality of conductors 210.

The plurality of conductors 210 may be coupled directly to the plurality of contacts 238 at an angle α of greater than 90 degrees to less than 180 degrees. The angle α may be formed between the axis 250 and the line 242.

The component 234 may comprise a die, a processor, a bus, a motherboard, and/or any other component that includes at least one plurality of contacts 238 arranged in a substantially linear fashion. Thus components 234 may also include connectors, such as ribbon cable connectors, card edge connectors, and even connectors with multiple rows or lines of contacts, such that the contacts 238 in each row are spaced apart in a substantially linear and periodic fashion. Components 234 may also include conductors, such as parallel conductors and/or angled parallel conductor groups.

The contacts 238 may comprise conductive areas and include, but are not limited to, electromagnetic ports, including optical ports, fingers, sockets, pins, vias, and pads, including pads having an adhesive, conductive material.

Some or all of the plurality of conductors 210 may be located over, under, or within a substrate 254, which may be flexible or non-flexible, and may include organic and/or inorganic material. The materials included in the substrate 254 may be non-conductive or conductive, and they may provide a supporting structure and/or insulating properties for one or more of the plurality of conductors 210, depending upon the configuration and requirements of the apparatus 230. The plurality of conductors 210 may comprise electrical conductors (e.g., copper conductors on multiple layers of FR4 (Fire Retardant Grade 4) circuit board material), radio frequency conductors (e.g., coaxial cable), optical conductors (e.g., fiber optics), and/or any other conductors that are capable of transferring energy from one location to another, as well as combinations thereof. Thus, the plurality of conductors 210 may be used to conduct any form of energy included in the electromagnetic spectrum.

Figure 3:
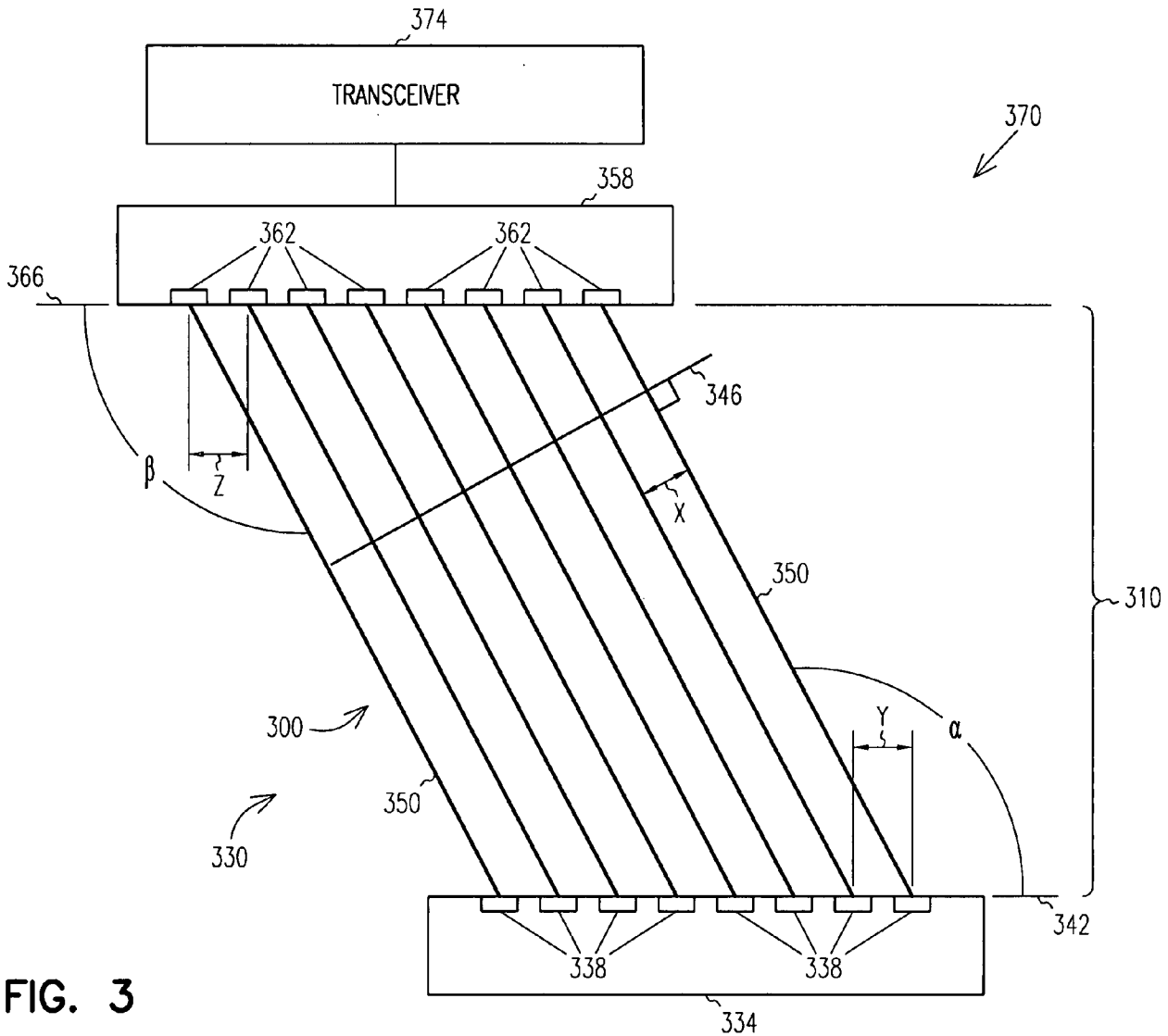
FIG. 3 is a top view of an apparatus and a system according to various embodiments of the invention.

FIG. 3 is a top view of an apparatus 330 and a system 370 according to various embodiments of the invention. In this case, the apparatus 330 may comprise a first component 334, a second component 358, and an angled parallel conductor 300. The component 334 may have a plurality of contacts 338 substantially equally spaced apart from each other by a distance Y along a line 342. The angled parallel conductor group 300 may have a plurality of conductors 310 in a sub-group substantially equally spaced apart from each other by a distance X, which may be less than the distance Y. The distance X may be measured along the line 346, which may be perpendicular to an axis 350 parallel to each one of the plurality of conductors 310.

The plurality of conductors 310 may be coupled directly to the plurality of contacts 338 at an angle $\alpha$ of greater than 90 degrees to less than 180 degrees. The angle $\alpha$ may be formed between the axis 350 and the line 342.

The second component 358 may have a plurality of contacts 362 substantially equally spaced apart from each other by a distance Z along a line 366. The distance Z may or may not be substantially equal to the distance Y, and may be greater than the distance X. The angle $\alpha$ may or may not be substantially equal to the angle $\beta$. The plurality of contacts 362 may be coupled directly to the plurality of conductors 310 at an angle $\beta$ of greater than 90 degrees to less than 180 degrees, formed between the axis 350 and the line 366.

Referring to FIGS. 1 and 2, it can be seen that each one of the plurality of conductors 110, 210 included in the angled parallel conductor group 100, 200 may be of a substantially different length than every other one of the plurality of conductors 110, 210. Referring to FIG. 3, it can be seen that each one of the plurality of conductors 310 included in the angled parallel conductor group 300 may also formed or selected so as to be substantially the same length as every other one of the plurality of conductors 310. Alternatively, each one of the plurality of conductors 310 may be of a substantially different length than every other one of the plurality of conductors 310.

Other embodiments of the invention may also be realized. For example, as shown in FIG. 3, a system 370 may comprise a wireless transceiver 374 and a component 358 capable of being operatively coupled to the wireless transceiver 374. As noted above, the component 358 may comprise any number and type of elements, including one or more connectors, dice, and/or memory elements. The system 370 may also comprise an angled parallel conductor group 300, which may be coupled to the plurality of contacts 362 of component 358 and to the plurality of contacts 338 of component 334.

Figure 4:
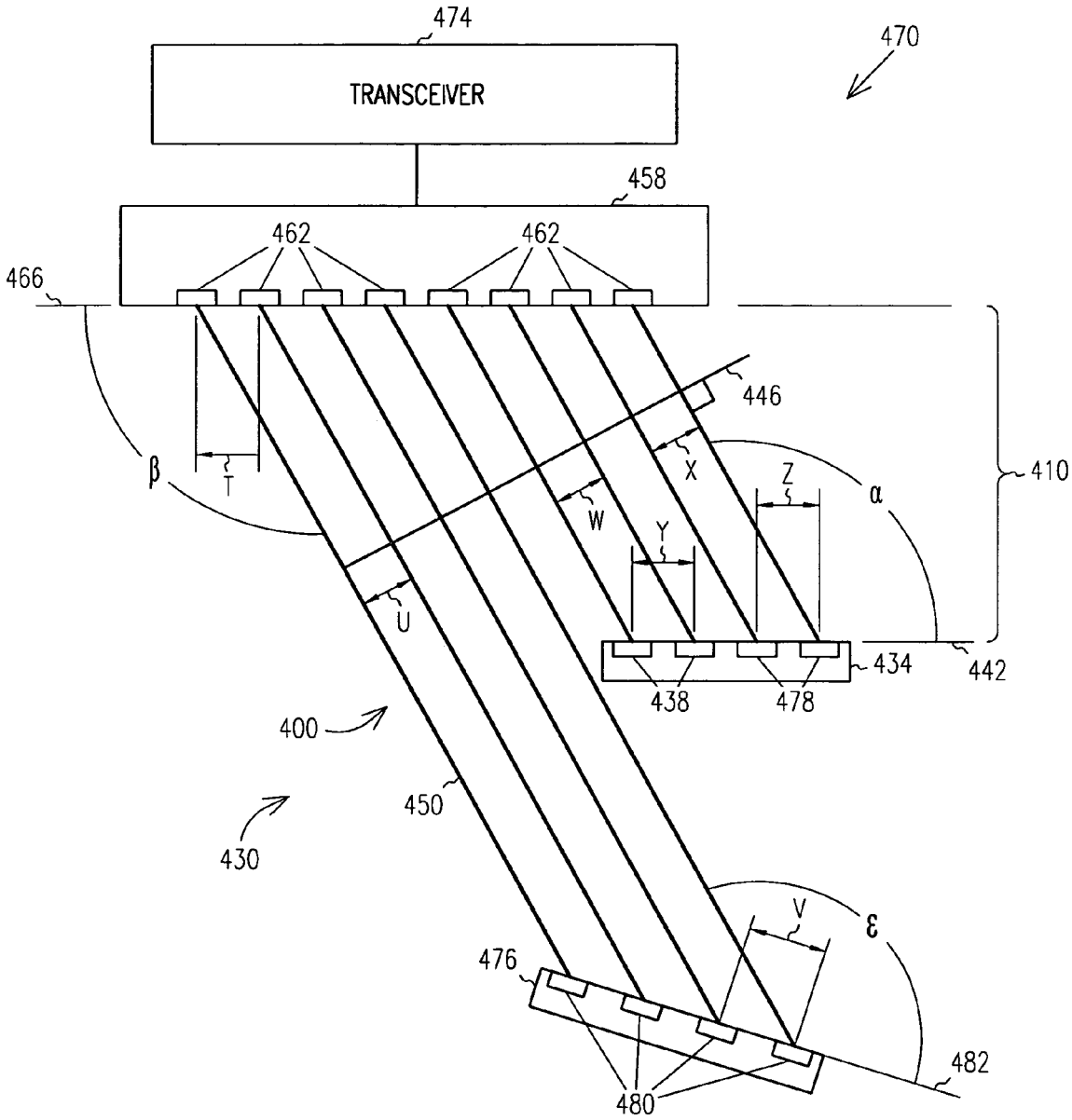
FIG. 4 is top view of another apparatus and system according to various embodiments of the invention.

FIG. 4 is top view of another apparatus 430 and system 470 according to various embodiments of the invention. As shown, the apparatus 430 may comprise a first component 434, a second component 458, a third component 476, and an angled parallel conductor 400. The component 434 may have a plurality of contacts 438 substantially equally spaced apart from each other by a distance Y along a line 442, and a plurality of contacts 478 substantially equally spaced apart from each other by a distance Z along the line 442. In this case, the angled parallel conductor group 400 may have a plurality of conductors 410 substantially parallel to each other and spaced apart from each other by a variety of pitch distances (e.g., in a variety of sub-groups), or at least by more than a single pitch distance, such as by a pitch distance U in a first sub-group, a pitch distance W in a second sub-group, and a different pitch distance X in a third sub-group, for example. Thus, the distance U may or may not be the same as the distance W. The distance X may or may not be different than the distance W and less than the distance Y. The distance W may be less than the distance Z. The distances W and X may be measured along the line 446, which may be perpendicular to an axis 450 parallel to each one of the plurality of conductors 410.

The plurality of conductors 410 may be coupled directly to the plurality of contacts 438 and the plurality of contacts 478 at an angle $\alpha$ of greater than 90 degrees to less than 180 degrees. The angle $\alpha$ may be formed between the axis 450 and the line 442.

The second component 458 may have a plurality of contacts 462 spaced apart from each other by a distance T along a line 466. The distance T may or may not be substantially equal to the distances Y and/or Z, and may be greater than the distance U, which is the parallel spacing of some of the conductors in the conductor group 400. The angle $\alpha$ may or may not be substantially equal to the angle $\beta$. The plurality of contacts 462 may be coupled directly to the plurality of conductors 410 at an angle $\beta$ of greater than 90 degrees to less than 180 degrees, formed between the axis 450 and the line 466.

The third component 476 may have a plurality of contacts 480 spaced apart from each other by a distance V along a line 482. The distance V may or may not be substantially equal to the distances Y and/or Z, and may be greater than the distance U, which is the parallel spacing of some of the conductors in the conductor group 400. The angle $\epsilon$ may or may not be substantially equal to the angle $\beta$. The plurality of contacts 480 may be coupled directly to some of the plurality of conductors 410 in the conductor group 400 at an angle $\epsilon$ of greater than 90 degrees to less than 180 degrees, formed between the axis 450 and the line 482.

Thus the spacing Z, T, Y, V of the contacts 438, 462, 478, and 480 may depend on the measure of the angles $\alpha$, $\beta$, and $\epsilon$, respectively, as well as the parallel spacing of the conductors U, W, and X in the conductor group 400. Therefore the spacing T, V, Y, and Z may be the same or different. The angles $\alpha$, $\beta$, and $\epsilon$ may be the same or different. Similarly, the spacing U, W, and X may be the same or different.

Other embodiments of the invention may also be realized. For example, a system 470 may comprise a wireless transceiver 474 and a component 458 capable of being operatively coupled to the wireless transceiver 474. As noted above, the component 458 may comprise any number and type of elements, including one or more connectors, dice, and/or memory elements. The system 470 may also comprise an angled parallel conductor group 400, which may be coupled to the plurality of contacts 462 of component 458 and to the plurality of contacts 438 of component 434.

It should also be understood that the apparatus and systems of various embodiments of the invention can be used in applications other than for multiple conductors and connectors, and other than for purely electrical energy transfer, and thus, embodiments of the invention are not to be so limited. The illustrations of an angled parallel conductor group 100, 200, 300, 400, an apparatus 230, 330, 430, and a system 370, 470 are intended to provide a general understanding of the structure of various embodiments of the invention, and they are not intended to serve as a complete description of all the elements and features of apparatus and systems that might make use of the structures described herein.

Applications that may include the novel apparatus and systems of various embodiments of the invention include electronic circuitry used in high-speed computers, communication and signal processing circuitry, data transceivers, modems, processor modules, embedded processors, and application-specific modules, including multilayer, multichip modules. Such apparatus and systems may further be included as sub-components within a variety of electronic systems, such as televisions, cellular telephones, personal computers, workstations, radios, video players, vehicles, and others.

Figure 5:
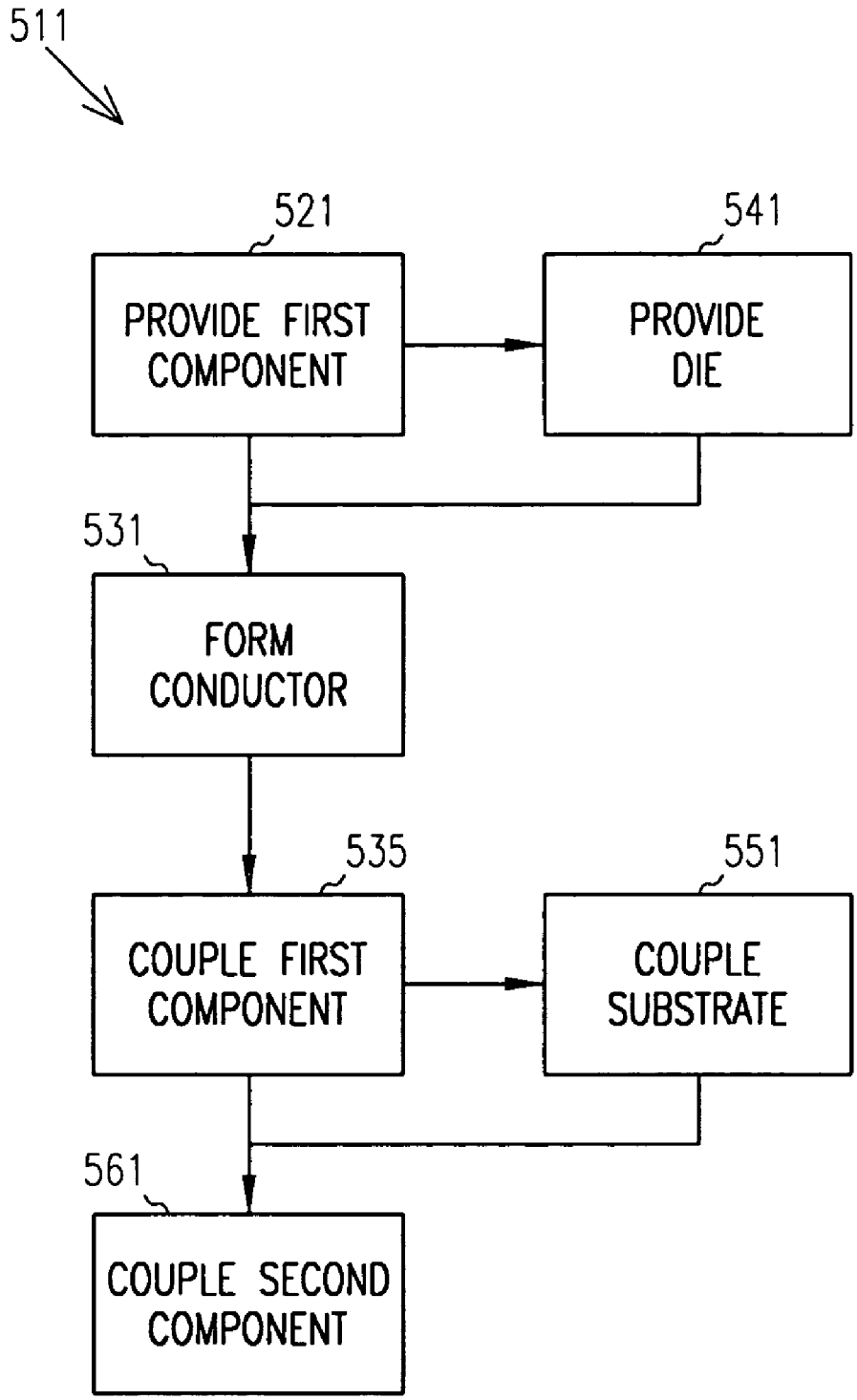
FIG. 5 is a flow chart illustrating several methods according to various embodiments of the invention.

FIG. 5 is a flow chart illustrating several methods according to various embodiments of the invention. A method 511 may begin with providing a component having a plurality of contacts substantially equally spaced apart from each other by a first distance along a first line at block 521. The method 511 may continue with forming an angled parallel conductor group on a substrate, flexible or inflexible, including a flexible organic substrate, at block 531.

The method 511 may then continue with coupling the angled parallel conductor group directly to the component at block 535. The plurality of conductors included in the angled parallel conductor group may be substantially equally spaced apart from each other by a second distance less than the first distance along a second line perpendicular to an axis parallel to each one of the plurality of conductors. The axis and the first line may form an angle of greater than 90 degrees to less than 180 degrees.

Providing the component at block 521 may further include providing a die including a circuit at block 541. Coupling the angled parallel conductor group at block 535 may further include coupling a substrate including the plurality of conductors directly to the die and/or the circuit (or the contacts of the die or circuit) at block 551.

The method 511 may also include coupling a second component directly to the angled parallel conductor group at block 561. The second component may have a second plurality of contacts substantially equally spaced apart from each other by a third distance greater than the second distance along a third line. The second plurality of contacts may be coupled directly to the plurality of conductors included in the angled parallel conductor group at a second angle formed between the axis and the third line of greater than 90 degrees to less than 180 degrees. As noted above, each one of the plurality of conductors included in the angled parallel conductor group may be substantially the same length as every other one of the plurality of conductors. Alternatively, each one of the plurality of conductors may be of a substantially different length than every other one of the plurality of conductors.

It should be noted that the methods described herein do not have to be executed in the order described, or in any particular order. Moreover, various activities described with respect to the methods identified herein can be executed in serial or parallel fashion.

Although specific embodiments have been illustrated and described herein, it should be appreciated that any arrangement calculated to achieve the same purpose may be substituted for the specific embodiments shown. This disclosure is intended to cover any and all adaptations or variations of various embodiments of the invention. It is to be understood that the above description has been made in an illustrative fashion and not a restrictive one. Combinations of the above embodiments, and other embodiments not specifically described herein, will be apparent to those of skill in the art upon reviewing the above description.

The scope of various embodiments of the invention includes any other applications in which the above structures and methods are used. Therefore, the scope of various embodiments of the invention should be determined with reference to the appended claims, along with the full range of equivalents to which such claims are entitled.

It is emphasized that the Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment.

What is claimed is:

1. An apparatus, comprising:

a first component having a first plurality of contacts spaced apart from each other by a first distance along a first line; and an angled parallel conductor group having a first plurality of substantially parallel conductors spaced apart from each other by a second distance less than the first distance along a second line perpendicular to an axis parallel to each one of the first plurality of conductors, wherein the first plurality of conductors are coupled directly to the first plurality of contacts at a first angle formed between the axis and the first line of greater than 90 degrees to less than 180 degrees, wherein all conductors within the angled parallel conductor group are substantially coplanar, and wherein the angled parallel conductor group is substantially coplanar with all conductors located within a cable comprising the angled parallel conductor group.

2. The apparatus of claim 1, further comprising:

a second component having a second plurality of contacts substantially equally spaced apart from each other by a third distance greater than the second distance along a third line, wherein the second plurality of contacts are coupled directly to the first plurality of conductors at a second angle formed between the axis and the third line of greater than 90 degrees to less than 180 degrees.

3. The apparatus of claim 2, wherein the first distance is substantially equal to the third distance, and wherein the first angle is substantially equal to the second angle.

4. The apparatus of claim 2, wherein the first distance is unequal to the third distance, and wherein the first angle is unequal to the second angle.

5. The apparatus of claim 2, wherein the second component comprises at least one connector.

6. The apparatus of claim 1, wherein the first component comprises a die.

7. The apparatus of claim 6, wherein the die comprises a processor.

8. The apparatus of claim 1, further comprising:

a second component having a second plurality of contacts substantially equally spaced apart from each other by a third distance greater than the second distance along a third line, wherein the second plurality of contacts are coupled directly to a second plurality of conductors included in the angled parallel conductor group at a second angle formed between the axis and the third line of greater than 90 degrees to less than 180 degrees.

9. The apparatus of claim 1, wherein the angled parallel conductor group comprises a plurality of electrical conductors.

10. The apparatus of claim 1, wherein the angled parallel conductor group comprises a plurality of optical conductors.

11. The apparatus of claim 1, wherein the angled parallel conductor group comprises a plurality of conductors on a flexible substrate.

12. The apparatus of claim 11, wherein the substrate comprises an organic material.

13. The apparatus of claim 1, wherein each one of the first plurality of conductors is substantially the same length as every other one of the first plurality of conductors.

14. The apparatus of claim 1, wherein each one of the first plurality of conductors is of a substantially different length than every other one of the first plurality of conductors.

15. A system, comprising:

a wireless transceiver;

a component to operatively couple to the wireless transceiver, the component having a plurality of contacts substantially equally spaced apart from each other by a first distance along a first line; and an angled parallel conductor group having a plurality of substantially parallel conductors equally spaced apart from each other by a second distance less than the first distance along a second line perpendicular to an axis parallel to each one of the plurality of conductors, wherein the plurality of conductors are coupled directly to the plurality of contacts at a first angle formed between the axis and the first line of greater than 90 degrees to less than 180 degrees, wherein all conductors within the angled parallel conductor group are substantially coplanar, and wherein the angled parallel conductor group is substantially coplanar with all conductors located within a cable comprising the angled parallel conductor group.

16. The system of claim 15, wherein the component comprises a connector.

17. The system of claim 15, wherein the component comprises a die.

18. The system of claim 15, wherein the component comprises a memory.

19. The system of claim 15, wherein the component comprises a processor.

20. A method, comprising:

coupling an angled parallel conductor group having a plurality of substantially parallel conductors directly to a component having a plurality of contacts substantially equally spaced apart from each other by a first distance along a first line, wherein the plurality of conductors are substantially equally spaced apart from each other by a second distance less than the first distance along a second line perpendicular to an axis parallel to each one of the plurality of conductors, wherein the axis and the first line form a first angle of greater than 90 degrees to less than 180 degrees, wherein all conductors within the angled parallel conductor group are substantially coplanar, and wherein the angled parallel conductor group is substantially coplanar with all conductors located within a cable comprising the angled parallel conductor group.

21. The method of claim 20, wherein the component comprises a die including a circuit.

22. The method of claim 21, wherein coupling the angled parallel conductor group directly to the component further comprises:

coupling a flexible substrate including the plurality of substantially parallel conductors directly to the circuit.

23. The method of claim 20, further comprising:

coupling a second component directly to the angled parallel conductor group, the second component having a second plurality of contacts substantially equally spaced apart from each other by a third distance greater than the second distance along a third line, wherein the second plurality of contacts are coupled directly to the plurality of conductors at a second angle formed between the axis and the third line of greater than 90 degrees to less than 180 degrees.

24. The method of claim 23, wherein each one of the plurality of conductors is substantially the same length as every other one of the plurality of conductors.

25. The method of claim 23, wherein each one of the plurality of conductors is of a substantially different length than every other one of the plurality of conductors.

26. The method of claim 20, further comprising:

forming the angled parallel conductor group on a flexible organic substrate.

27. An apparatus, comprising:

a first component having a first plurality of contacts spaced apart from each other by a first distance along a first line and a second plurality of contacts spaced apart from each other by a second distance along the first line;

an angled parallel conductor group having a first plurality of substantially parallel conductors spaced apart from each other by a third distance less than the first distance, along a second line perpendicular to an axis parallel to each one of the first plurality of conductors, wherein the first plurality of conductors are coupled directly to the first plurality of contacts at a first angle formed between the axis and the first line of greater than 90 degrees to less than 180 degrees, the angled parallel conductor group having a second plurality of substantially parallel conductors spaced apart from each other by a fourth distance along the second line less than the second distance along the first line, wherein the second plurality of conductors are coupled directly to the second plurality of contacts at the first angle, wherein all conductors within the angled parallel conductor group are substantially coplanar, and wherein the angled parallel conductor group is substantially coplanar with all conductors located within a cable comprising the angled parallel conductor group.

28. The apparatus of claim 27, further comprising:

a second component having a third plurality of contacts spaced apart from each other by a fifth distance along a third line; and a third plurality of substantially parallel conductors within the angled parallel conductor group, spaced apart from each other by a sixth distance along the second line less than the fifth distance, wherein the third plurality of contacts are coupled directly to the third plurality of conductors at a second angle formed between the axis and the third line of greater than 90 degrees to less than 180 degrees.

29. The apparatus of claim 28, wherein the first distance is not equal to the fifth distance, and wherein the first angle is not equal to the second angle.

* * * * *